United States Patent [19]

Fotland et al.

[11] 4,195,927

[45] Apr. 1, 1980

[54] DOUBLE TRANSFER ELECTROPHOTOGRAPHY

[75] Inventors: Richard A. Fotland; Jeffrey J. Carrish, both of Holliston, Mass.

[73] Assignee: Dennison Manufacturing Company, Framingham, Mass.

[21] Appl. No.: 873,747

[22] Filed: Jan. 30, 1978

[51] Int. Cl.[2] ..... G03G 15/00

[52] U.S. Cl. ..... 355/3 TE; 355/3 TR; 430/48

[58] Field of Search ..... 355/3 TE, 3 TR, 3 FU, 355/3 BE, 3 DD; 96/1.4, 1 TE; 427/19

[56] References Cited

U.S. PATENT DOCUMENTS

| | | | |
|---|---|---|---|
| 2,990,278 | 6/1961 | Carlson | 355/3 TR |
| 3,043,684 | 7/1962 | Mayer | 96/1.4 |
| 3,854,975 | 12/1974 | Brennman et al. | 355/3 FU |
| 4,073,583 | 2/1978 | Teumer et al. | 355/3 FU X |

*Primary Examiner*—R. L. Moses

*Attorney, Agent, or Firm*—George E. Kersey

[57] ABSTRACT

An electrophotographic system employing double image transfer. A photoconductive member is charged and exposed to form a latent electrostatic image, which is then transferred to a drum with a durable dielectric coating. The latent electrostatic image is subsequently toned and transferred by pressure to a recording medium, with or without simultaneous pressure fixing.

16 Claims, 4 Drawing Figures

DOUBLE TRANSFER ELECTROPHOTOGRAPHY

BACKGROUND OF THE INVENTION

This invention relates to electrophotographic reproduction systems and, in particular, to electrophotographic reproduction systems involving more than one transfer of an image.

The conventional and well-known prior art electrophotographic process employing plain paper consists of uniformly charging a photoconductor electrostatically in the dark, exposing the charged photoconductor to an image corresponding to the image to be reproduced, toning the electrostatic latent image, and subsequently transferring the toned image, usually by electrostatic means, to plain paper. The tone image transferred to the plain paper is then fused, typically by thermal means. This transfer is never total, and thus residual toner on the photoconductor must be removed, generally by a cleaning brush. The cleaning process, frequently repeated, can damage a delicate photoconductor surface. Furthermore, the numerous process steps lead to a costly and complex photocopying system.

A solution to this problem, known in the art, involves a transfer of the recorded latent electrostatic image from the photoconductive member to a more durable dielectric member, where development, transfer, and cleaning occurs. This confines the photoconductor to a recording function, perhaps with post transfer erasure of any residual electrostatic image.

A system utilizing this concept is described by G. Krulik and H. Sable in U.S. Pat. No. 3,937,571, and by H. Sable in U.S. Pat. No. 3,907,560. Here, the latent electrostatic image on an image drum is formed by means of an ion modulating screen, which allows the ion to pass in a pattern corresponding to the original image, and thence onto the image drum. Use of such a screen is awkward, however, and in particular results in an excessive first-copy time.

Another electrophotographic system of this nature is disclosed by W. R. Buchan et al. in U.S. Pat. No. 3,947,113, and U.S. Pat. No. 4,015,017. In this method, toner is transferred from a photoconductive drum to an intermediate silicone transfer belt. This apparatus is similarly cumbersome, and does not completely avoid the necessity of cleaning residual toner from the photoconductive member.

Systems utilizing charge transfer between two insulating sheets have been analyzed, and in the realm of photocopying, this phenomenon has been given the acronym T.E.S.I., standing for Transfer of Electrostatic Image. This process is described in *Xerography and Related Process,* edited by John H. Desrauer and Harold E. Clark, The Focal Press, London and New York, 1965, at page 432. T.E.S.I. relies on an air gap breakdown in the region between the two insulating members, which results in a transfer of charge from one member to another through an ionization of the intervening air. The special problem which is associated with the transfer of charge upon the approach of two insulating sheets with an external applied potential is that disruptive transfer of charge. Disruptive charge transfer typically results in a mottling of the transferred image.

A problem which often occurs in conventional electrophotographic apparatus is that of undesirable photoconductor discharge characteristics. Between uniform charging and exposure of the photoconductor, there is invariably some loss of potential due to so-called dark discharge. During exposure to the light and shadow image, the photoconductor theoretically loses its charge according to the intensity of light exposure and the length of time of such exposure. Discharge curves (plots of photoconductor potential as a function of time), however, invariably do not show a linear function of photoconductor potential with respect to time; the rate of discharge generally decreases with time, and the curve levels off at a residual potential, below which no discharge occurs. These characteristics result in a smaller contrast potential—the difference between the residual potential and the potential immediately before exposure—which decreases the toner image contrast. Furthermore, non-linearity in the high voltage region of the discharge curve results in a loss of fidelity for the electrostatic counterpart of the original optical image. The presence of a residual potential in a high speed photocopying device leads to the further problem of residual potential buildup, which occurs when there is insufficient erasure of the residual image between cycles.

Accordingly, it is a principal object of this invention to provide a plain paper electrophotographic system which is simple, compact, and low in cost. A related object is to provide an electrophotographic system which requires fewer process steps than those of a conventional system. A further related object is to achieve a plain paper copying system having an extremely short and simple paper path.

Another object of the invention is to provide a more reliable and maintenance free electrophotographic system with a photoconductive member of increased efficiency and life span. A related object is to avoid the need to clean the photoconductive member.

A further object of the invention is to design a system which is indifferent to idiosyncratic photoconductor electrical properties. In particular, it is desirable that an electrophotographic system avoid the problems inherent in the presence of a residual potential as well as non-linear characteristics in the toe of a photoconductor discharge curve.

Another object of the invention is the maintenance of reasonable image quality during the initial image transfer. A related object is the avoidance of disruptive charge transfer between a photoconductor and a dielectric image member.

Yet another object of the invention is to achieve a plain paper copier system in which the time required to generate the first copy is reduced.

SUMMARY OF THE INVENTION

In furthering the above and related objects, the electrophotographic apparatus of the invention is comprised of a photoconductor member, a dielectric image drum, and various process stations. In accordance with one aspect of the invention, the photoconductor member contains a photoconductive surface and a conducting inner substrate, while the dielectric image drum contains an insulating surface layer and a conducting substrate. In accordance with a particular embodiment of the invention, the above members take the form of cylindrical drums. In accordance with a related aspect of the invention, a latent electrostatic image is formed by uniformly charging the photoconductive surface in the dark, and then exposing it to a pattern of light and shadow corresponding to the original image to be reproduced. In accordance with a further related aspect of the invention, the latent electrostatic image is next transferred to the surface of the dielectric image drum. An erase lamp may be used to discharge a residual latent image on the photoconductive surface after image transfer.

In accordance with another aspect of the invention, the latent electrostatic image on the dielectric image drum is toned to form a visible counterpart. The toned image is then transferred to a receptor medium. Means may be included to clean the surface of the dielectric image drum, and to discharge any residual image thereon.

In accordance with a further aspect of the invention, the latent electrostatic image is transferred from the photoconductor member to the dielectric image drum by bringing the surface of the latter into either contact or close proximity with the image bearing region of the former. An external bias potential may be introduced between the conducting substrates of these members. Charge transfer is effected by means of an air gap breakdown, upon achieving a threshold potential.

In accordance with a preferred embodiment of the invention, the photoconductor member may contain a semiconducting layer between the photoconductive surface and the conducting substrate. In accordance with a related aspect of the invention, this preferred construction of the photoconductor member prevents a disruptive charge transfer from such member to the dielectric image drum, and enhances the quality of the transferred latent electrostatic image.

In accordance with another particular embodiment of the invention, the toned, visible image may be transferred to the receptor with simultaneous pressure fixing. Pressure is applied when a receptor web or sheet passes between the dielectric image drum and a backup roller at a point of tangency of the two members.

DESCRIPTION OF THE DRAWINGS

In accordance with a preferred embodiment of the electrophotographic apparatus of the invention.

In accordance with an alternative embodiment of the electrophotographic apparatus of the invention.

DETAILED DESCRIPTION

Figure 1:
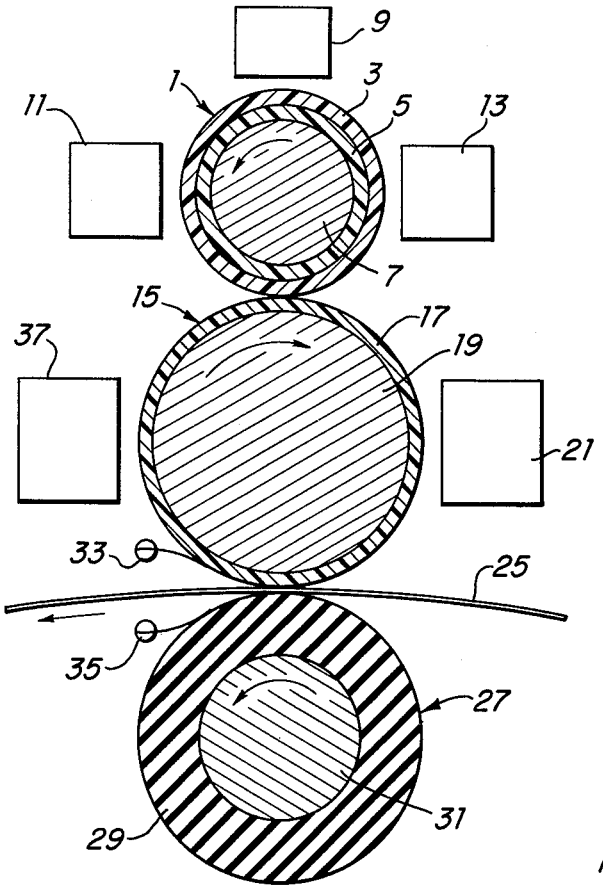
FIG. 1 is a schematic view of the entire electrophotographic apparatus.

Reference should be had to the accompanying drawings for a detailed description of the invention. The electrophotographic system of the invention as illustrated in the embodiment of FIG. 1 is comprised of three cylinders, and various process stations.

The upper cylinder is a photoconductive member 1, which includes a photoconductor coating 3 supported on a conducting substrate 7, with an intervening semiconducting substrate 5. This three-layer photoconductive member is the subject of copending application Ser. No. 807,451, and possesses advantages with respect to the photocopying process which are discussed below. Advantageous materials for the photoconductive surface layer include cadmium sulfide powder dispersed in a resin binder (photoconductive grade CdS is employed, typically doped with activating substances such as copper and chlorine), cadmium sulfoselenide powder dispersed in a resin binder (defined by the formula $CdS_xSe_y$, where $x+y=1$), or organic photoconductors such as the equimolar complex of polyvinyl carbazole and trinitrofluorenone.

The photoconductor is uniformly electrostatically charged at charging station 9 and then exposed at exposing station 11 to form on the surface of the photoconductor an electrostatic latent image of an original. The photoconductor may advantageously be charged employing a conventional corona wire assembly, or alternatively it may be charged using the ion generating scheme described in co-pending application Ser. No. 824,252. The optical image which provides the latent image on the photoconductor may be generated by any of several optical scanning schemes well known to those skilled in the art. This latent image is transferred to a dielectric cylinder 15 consisting of a dielectric layer 17 coated on a metal cylinder 19.

In order to provide uniformity from copy to copy, particularly with certain photoconductors which exhibit fatigue, it is necessary to discharge the residual latent image remaining on the photoconductor after the latent image has been transferred to dielectric surface 17. This erasure may be conveniently carried out by erase lamp 13 which must provide sufficient illumination to discharge the photoconductor below some required level. The erase light 13 may take the form of either a fluorescent or incandescent lamp.

The dielectric layer 17 of the dielectric cylinder 15 should have sufficiently high resistance to support a latent electrostatic image during the period between transfer of the latent image and toning. Consequently, the resistivity of the layer 17 must be in excess of $10^{12}$ ohm-centimeters. The preferred thickness of the insulating layer 17 is 0.001 to 0.003 inches. In addition, the surface of the layer 17 should be highly resistant to abrasion and relatively smooth, with a finish that is preferably better than 10 micro-inch rms, in order to provide for complete transfer of toner to the receptor sheet 25. The dielectric layer 17 additionally has a high modulus of elasticity so that it is not distorted significantly by high pressures in the transfer nip.

A number of organic and inorganic dielectric materials are suitable for the layer 17. Glass enamel, for example, may be deposited and fused to the surface of a steel or aluminum cylinder. Flame or plasma sprayed high density aluminum oxide may also be employed in place of glass enamel. Plastic materials, such as polyamides, polyimides, and other tough thermoplastic or thermoset resins are also suitable. However, the preferred dielectric coating is impregnated, anodized aluminum oxide as described in co-pending patent application Ser. No. 822,865, filed Aug. 8, 1977.

The latent electrostatic image on dielectric surface 17 is transferred to a visible image at toning station 21. While any conventional electrostatic toner may be used, the preferred toner is of the single component conducting magnetic type described by J. C. Wilson, U.S. Pat. No. 2,846,333, issued Aug. 5, 1958. This toner has the advantage of simplicity and cleanliness.

The toned image is transferred and fused onto a receptive sheet 25 by high pressure applied between rollers 15 and 27. The bottom roller 27 consists of a metallic core 31 which may have an outer covering of engineering plastic 29. The pressure required for good fusing to plain paper is governed by such factors as, for example, roller diameter, the toner employed, and the presence of any coating on the surface of the paper. Typical pressures range from 100 to 700 lbs. per linear inch of contact. The function of the plastic coating 29 is to absorb any high stresses introduced into the nip in the case of a paper jam or wrinkle. By absorbing stress in the plastic layer 29, the dielectric coated roller 15 will not be damaged during the accidental paper wrinkles or jams. Coating 29 is typically a nylon or polyester sleeve having a wall thickness in the range of ⅛ to ½". This coating need not be used, for example, if a high controlled web is printed for which paper wrinkles and jams are not likely to occur.

Scraper blades 33 and 35 may be provided in order to remove any residual paper dust, toner accidentally impacted on the rollers and airborne dust and dirt from the dielectric pressure cylinder and the backup pressure roller. Since substantially all of the toned image is transferred to the receptor sheet 25, the scraper blades are not required, but are desirable in promoting reliable operation over an extended period.

Figure 2:
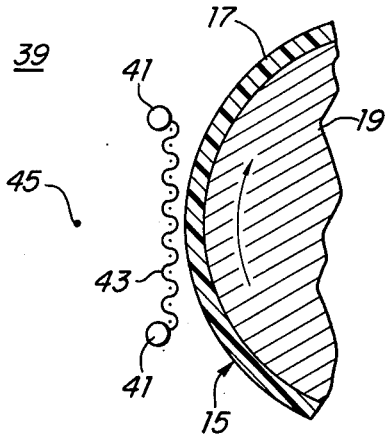
FIG. 2 is a partial sectional view of a shielding eraser unit for the electrophotographic apparatus of FIG. 1.

The small residual electrostatic latent image remaining on dielectric surface 17, after transfer of the toned image, may be neutralized at the latent image discharge station 37. The action of toning and transferring a toned latent image to a plain paper sheet reduces the magnitude of the electrostatic image, typically from several hundred volts to several tens of volts. In some cases, if the toning threshold is too low, the presence of a residual latent image will result in ghost images on the copy sheet, which are eliminated by the discharge station 37. Such erasure may be performed with arrangement 39 of FIG. 2. In FIG. 2, the dielectric cylinder 15, with a dielectric coating 17, is maintained in contact with, or a short distance from an open mesh screen 43, maintained at substantially the same potential as the conducting cylinder 19. The screen is mounted on holder 41, and an AC corona wire 45 is positioned behind the screen at a distance of typically ¼ to ½". A high voltage alternating potential, illustratively 60 Hertz, is applied to the wire 45. The screen 43 establishes a reference ground plane near the dielectric surface and the AC corona wire 45 supplies both positive and negative ions. Any local field at the screen 43 due to a latent electrostatic image on the dielectric surface 17 attracts ions generated by the corona wire 45 onto the dielectric layer, thus neutralizing the majority of any residual charge. A very high surface velocities of dielectric coating 17, the remaining charge can again result in ghost images. In this case, multiple discharge stations will further reduce the residual charge to a level below the toning threshold.

Alternatively, erasure of any latent electrostatic image can be accomplished by using a high frequency AC discharge between electrodes separated by a dielectric as described in co-pending application Ser. No. 824,252, filed Aug. 12, 1977.

The latent residual electrostatic image may also be erased by contact discharging. The surface of the dielectric must be maintained in intimate contact with a grounded conductor or grounded semi-conductor in order effectively to remove any residual charge from the surface of the dielectric layer 17, for example, by a heavily loaded metal scraper blade. The charge may also be removed by a semi-conducting roller which is pressed into intimate contact with the dielectric surface.

Figure 3:
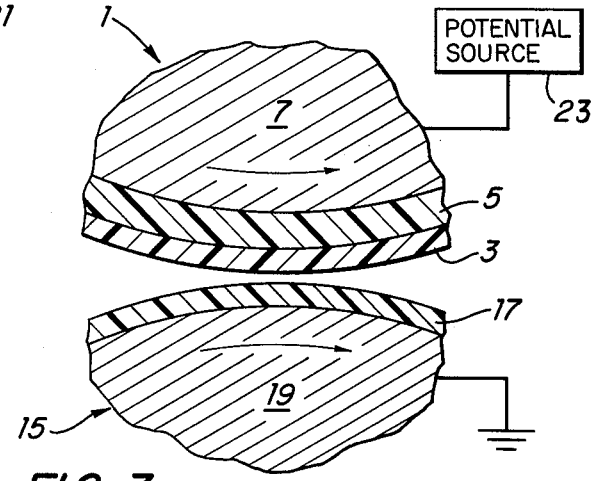
FIG. 3 is a partial sectional view of the region of proximity of a photoconductor member and a dielectric image drum.

The method by which a latent electrostatic image is transferred from photoconductor 3 to the dielectric cylinder 15 employs a charge transfer by air gap breakdown. The process of uniformly charging and exposing the photoconductive surface 3 results in a charge density distribution corresponding to the exposed image, and a variable potential pattern of the photoconductive surface 3 with respect to the grounded conductive substrate 7. With reference to FIG. 3, the charged area of the photoconductor 1 is rotated to a position of close proximity (no more than two thousandths of an inch) to the dielectric surface 17. An external potential 23 is applied between electrodes in the conductive substrates, 7 and 19, of the two drums. Typical figures here would be an initial charge of around 1,000 volts on photoconductive layer 3, to which an additional 400 volts is added by the externally applied potential 23. The aggregate charge of 1,400 volts is decreased by around 800 volts during the exposing process.

The charge transfer process requires that a sufficient electrical stress be present in the air gap to cause ionization of the air. The required potential depends on the thickness and dielectric constants of the insulating materials, as well as the distance of the air gap, as discussed in Dessauer and Clark, supra, at 427. Electrical stress will vary according to the local change density, but if sufficient to cause an air gap breakdown, will result in a transfer of charge from photoconductor surface 3 to dielectric surface 17, in a pattern duplicating the latent image. This means that a certain threshold potential must be generated across the air gap. Roughly half the charge will be transferred, leaving a potential of around 600 volts on the dielectric surface 17.

The necessary threshold potential may exist as a result of the uniform charging and exposure of the photoconductor surface 3, or an externally applied potential may be employed in addition. Image quality is generally enhanced through the use of an external potential.

A special concern in an electrophotographic application of this type of charge transfer is that of maintaining the integrity of the latent electrostatic image. This requires awareness of the phenomenon of disruptive charge transfer, which occurs under certain conditions when charge transfer is effected on the approach of the two insulating surfaces. It has been observed that the addition of a semi-conducting layer 5 between the photoconductive surface layer 3 and the conducting substrate 7 considerably reduces this effect as compared with using the usual two-layer photoconductor. Suitable layer characteristics and materials are disclosed in co-pending application Ser. No. 816,012. The employment of this preferred construction of the photoconductor member 1 avoids a mottling and blurring of detail in the transferred image. A typical range of air gap distances for charge transfer using this configuration would be on the order of 0.5 to 1.5 mils.

The use of this method of charge transfer alleviates some of the problems resulting from undesirable discharge characteristics of the photoconductive member. The employment of an external bias potential in achieving a threshold potential leaves a higher voltage on the dielectric drum than would be the case for a single transfer system relying on the contrast potential of the photoconductor surface. This, in turn, results in a greater contrast between the light and dark portions of the toned, visible image.

In a specific operative example of an electrophotographic system in accordance with the invention, the system was assembled as diagrammed in FIG. 1. The cylindrical conducting core 19 of the dielectric cylinder 15 was machined for 7075-T6 aluminum to a three inch diameter. The length of this cylindrical core, excluding machined journals, was nine inches. The journals were masked, and the aluminum anodized by use of the Sanford process (see S. Wernick and R. Pinner, "The Surface Treatment and Finishing of Aluminum and its Alloys", Robert Draper Ltd., 4th Edition, 1971/72, Vol. 2, Page 567). The finished aluminum oxide layer was 60 microns in thickness. The conducting core 19 was next heated in a vacuum oven at a temperature of 150° C. for twelve hours and then permitted to cool to 50° C. After removal from the oven, the cylindrical core was brush-coated with a low viscosity epoxy (Hysol Co. R9-2039 resin—100 parts by weight; H2-3404 hardener—11 parts by weight). The epoxy was allowed to impregnate the pores, and the excess on the surface then wiped off. The epoxy was cured at 78° for eighteen hours in a vacuum oven, thereby forming dielectric surface layer 17. The surface 17 of the dielectric cylinder 15 was then finished to 5 to 10 micro-inches rms using 600 grit silicon carbide paper.

The pressure roller 27 consisted of a solid machined 2-inch diameter core 31 over which was press fit a 2-inch inner diameter, 2.5-inch outer diameter polysulfone sleeve 29.

The conducting substrate 7 of photoconductor member 1, comprising an aluminum sleeve, was fabricated of 6061 aluminum tubing with a ⅛ of an inch wall and a 2-inch outer diameter. The outer surface was machined and the aluminum anodized (again, using the Sanford process) to a thickness of 50 microns. In order to proivde the proper level of oxide layer conductivity, nickel sulfide was precipitated in the oxide pores by dipping the anodized sleeve in a solution of nickel acetate (50 g/l, pH of 6) for 3 minutes. To form the semiconducting layer 5, the sleeve was then immediately immersed into concentrated sodium sulfide for 2 minutes and then rinsed in distilled water. This procedure was repeated three times. The impregnated anodic layer was then sealed in water (92° Celsius, pH of 5.6.) for ten minutes. The semiconducting substrate 5 was spray cooated with a binder layer photoconductor 3 consisting of photoconductor grade cadmium sulfo-selenide powder milled with a heatset DeSoto Chemical Co. acrylic resin, diluted with methyl ethyl ketone to a viscosity suitable for spraying. The dry coating thickness was 40 microns, and the cadmium pigment concentration in the resin binder was 18% by volume. The resin was crosslinked by firing at 180° C. for three hours.

The dielectric cylinder 15 was gear driven from an AC motor to provide surface speed of eight inches per second. The pressure roller 27 was mounted on pivoted and spring loaded side frames, causing it to press against the dielectric cylinder 15 with a pressure of 300 pounds per linear inch of contact.

Strips of 1 mil tape (⅛ inch wide) were placed around the circumference of the photoconductor sleeve 1 at each end in order to space the photoconductor at a small interval from the oxide surface of the dielectric cylinder 15. The photoconductor sleeve was freely mounted in bearings and friction driven by the tape which rested on the oxide surface.

The photoconductor charging corona 9, single component latent image toning apparatus 21, and optical exposing system 11 were all essentially identical to those employed in the Develop KG Dr. Eisbein & Co., (Stuttgart) No. 444 copier.

Flexible stainless steel scraper blades 33 and 35 were employed to maintain cleanliness of both the oxide cylinder 15 and the polysulfone pressure roll 27. With reference to the electrostatic image erasing embodiment shown at 39 in FIG. 2, the residual latent image was erased using an AC corona 45 in combination with a 42% open area 90 mesh screen 43, which was maintained at ground potential and pressed into light contact with the oxide surface 17. A 3 mil diameter tungsten corona wire 45 was spaced 3/16 inch from the screen. This corona wire was operated at an AC 60 Hertz potential with a peak of 9 kilovolts.

With reference to the photoconductor-dielectric cylinder embodiment of FIG. 3, a DC power supply 23 was employed to bias the photoconductor sleeve 1 to a potential of minus 400 volts relative to the dielectric cylinder core 19, which was maintained at ground potential. The photoconductor surface 3 was charged to a potential of minus 1,000 volts relative to its substrate 7. An optical exposure of 25 lux-seconds was employed in discharging the photoconductor in high-light areas. In undischarged areas, a latent image of minus 400 volts was transferred to the oxide dielectric 17. This image was toned, and then transferred to plain paper 25 which was injected into the pressure nip, at the appropriate time, from a sheet feeder.

Copies were obtained at a rate of 30 per minute, having clean background, dense black images, and a resolution in excess of twelve line pairs per millimeter. No image fusing, other than that occurring during pressure transfer, was required.

Figure 4:
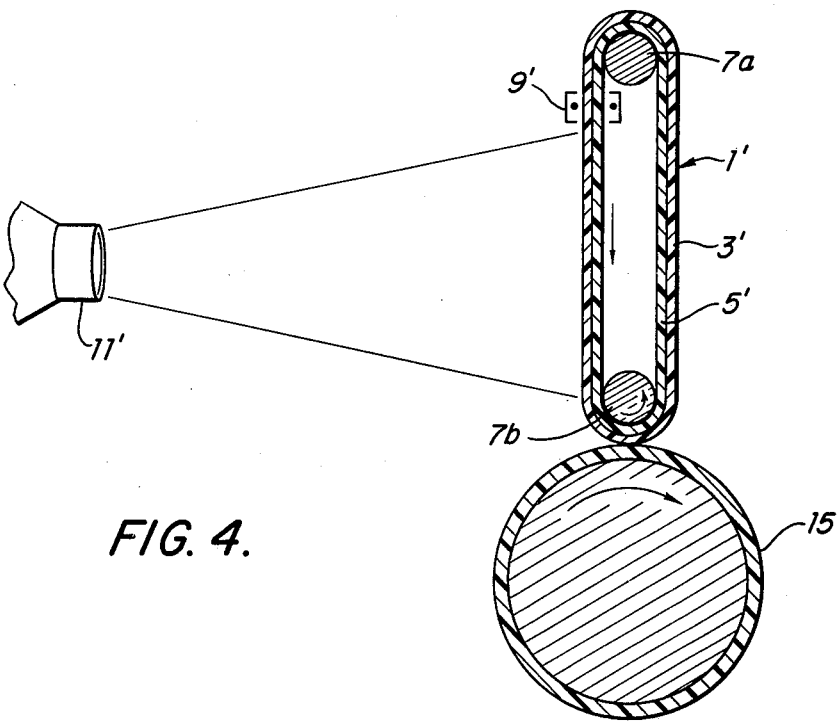
FIG. 4 is a schematic view of a belt photoconductor member and a dielectric image drum.

In another embodiment of the double transfer copier, the photoconductor sleeve 1 was replaced with a flexible belt photoconductor 1', as shown in FIG. 4. The photoconductor 1' is comprised of a photoconductor layer 3' which was formed from a one to one molar solution of polyvinyl carbazole and trinitrofluorenone dissolved in tetrahydrafuran, and coated onto a conducting paper base 5' (West Virginia Pulp and Paper 45# LTB base paper) to a dry thickness of 30 microns. The photoconductor belt 1' was supported by two conducting rollers **7*a* and 7*b*, and friction driven from the dielectric cylinder 15. The lower roller 7*b* was biased to minus 400 volts. The photoconductor 3' was charged to 1,000 volts with the double corona assembly 9' as shown in FIG. 4. The electrostatic latent image was generated by a flash exposure 11'** so that the entire image frame was generated without the use of scanning optics.

The rest of the system was identical to the previous example, with the exception of the dielectric cylinder 15, which was fabricated from non-magnetic stainless steel coated with a 15 micron layer of high density alumninum oxide. The coating was applied using a Union Carbide Corp. (Linde Division) plasma spray technique. After spraying, the oxide surface was ground and polished to a 10 microinch rms finish.

Again, high quality copies were obtained, even at operating speeds as high as 30 inches per second.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. Electrophotographic apparatus employing a double transfer of an image comprising:

a photoconductor member containing a photoconductive surface layer and a conducting inner substrate;

means for uniformly charging said photoconductive surface layer;

means for exposing the uniformly charged photoconductive surface layer to a pattern of light and shadow representing an original to be reproduced, whereby the surface layer is selectively discharged and a latent electrostatic image is produced thereon;

dielectric image drum means having an insulating surface and a conducting substrate onto which said latent electrostatic image is transferred by means of the ionization of air in a gap between said image drum and said photoconductive member;

means for applying a potential difference between the conducting inner substrate of said photoconductor member and the conducting substrate of said dielectric image drum, thereby inducing an electrical stress in said air gap and enhancing the ionization of air therein;

means for toning said latent electrostatic image to form a visible counterpart; and means for transferring the toned, visible image to a receptor.

2. Electrophotographic apparatus employing a double transfer of an image comprising:

a photoconductor member containing a photoconductive surface layer, a conducting inner substrate, and a semiconductive layer interposed between the photoconductive surface layer and the inner substrate;

means for uniformly charging said photoconductive surface layer;

means for exposing the uniformly charged photoconductive surface layer to a pattern of light and shadow representing an original to be reproduced, whereby the surface layer is selectively discharged and a latent electrostatic image is produced thereon;

dielectric image drum means having an insulating surface and a conducting substrate onto which said latent electrostatic image is transferred by means of the ionization of air in a gap between said image drum and said photoconductive member;

means for toning said latent electrostatic image to form a visible counterpart; and means for transferring the toned, visible image to a receptor.

3. The electrophotographic apparatus as defined in claim 2 further comprising means for applying a potential difference between the conducting inner substrate of said photoconductor member and the conducting substrate of said dielectric image drum means, thereby inducing an electrical stress in said air gap and enhancing the ionization of air therein.

4. The electrophotographic apparatus as defined in claim 2 wherein the means for transferring the toned, visible image to a receptor simultaneously fixes the image thereto by pressure.

5. The electrophotographic apparatus as defined in claim 4 wherein the means for simultaneous image transfer and pressure fixing comprises a rotatable pressure drum in contact with said dielectric image drum, and a receptor web which passes between the dielectric image drum and said pressure drum at the point of contact.

6. The electrophotographic apparatus as defined in claim 2 wherein the dielectric image drum is comprised of porous anodized aluminum impregnated with an insulating material.

7. The electrophotographic apparatus as defined in claim 2 wherein said photoconductor member comprises a photoconductor drum which is separated from said dielectric image drum by no more than two thousandths of an inch.

8. The electrophotographic apparatus as defined in claim 2 wherein said photoconductor member comprises a flexible belt.

9. The electrophotographic apparatus as defined in claim 2 wherein said semi-conductive layer is composed of porous anodized aluminum.

10. Electrophotographic apparatus employing a double transfer of an image comprising:

a photoconductor member containing a photoconductive surface layer and a conducting inner substrate;

two electrodes separated by a dielectric, means for producing an alternating frequency, high voltage discharge between said electrodes, and means for generating an auxiliary electric field to extract ions from said discharge in order to uniformly charge said photoconductive surface layer;

means for exposing the uniformly charged photoconductive surface layer to a pattern of light and shadow representing an original to be reproduced, whereby the surface layer is selectively discharged and a latent electrostatic image is produced thereon;

dielectric image drum means having an insulating surface and a conducting substrate onto which said latent electrostatic image is transferred by means of the ionization of air in a gap between said image drum and said photoconductive member;

means for toning said latent electrostatic image to form a visible counterpart; and means for transferring the toned, visible image to a receptor.

11. Electrophotographic apparatus employing a double transfer of an image comprising:

a photoconductor member containing a photoconductive surface layer and a conducting inner substrate;

means for uniformly charging said photoconductive surface layer;

means for exposing the uniformly charged photoconductive surface layer to a pattern of light and shadow representing an original to be reproduced, whereby the surface layer is selectively discharged and a latent electrostatic image is produced thereon;

dielectric image drum means having an insulating surface and a conducting substrate onto which said latent electrostatic image is transferred by means of the ionization of air in a gap between said image drum and said photoconductive member;

means for toning said latent electrostatic image to form a visible counterpart;

means for transferring the toned, visible image to a receptor; and means to erase any electrostatic image after transfer of the toned image has been completed, comprising two electrodes separated by a dielectric, and means for producing an alternating frequency, high voltage discharge between said electrodes, wherein one of said electrodes is disposed nearer the insulating surface of said dielectric image drum and held at the same potential as said conducting substrate.

12. Electrophotographic apparatus employing a double transfer of an image comprising:

a photoconductor member containing a photoconductive surface layer and a conducting inner substrate;

means for uniformly charging said photoconductive surface layer;

means for exposing the uniformly charged photoconductive surface layer to a pattern of light and shadow representing an original to be reproduced, whereby the surface layer is selectively discharged and a latent electrostatic image is produced thereon;

dielectric image drum means having an insulating surface and a conducting substrate onto which said latent electrostatic image is transferred by means of the ionization of air in a gap between said image drum and said photoconductive member;

means for toning said latent electrostatic image to form a visible counterpart;

means for transferring the toned, visible image to a receptor; and a grounded conductor or grounded semiconductor which is maintained in intimate contact with the insulating surface of said dielectric image drum in order to erase any remaining electrostatic image after transfer of the toned image has been completed.

13. The electrophotographic apparatus as defined in claim 12 wherein said grounded conductor consists of a heavily loaded metal scraper blade.

14. The electrophotographic apparatus as defined in claim 12 wherein said grounded semi-conductor consists of a semi-conducting roller.

15. Electrophotographic apparatus employing a double transfer of an image comprising:

a photoconductor member containing a photoconductive surface layer and a conducting inner substrate;

means for uniformly charging said photoconductive surface layer;

means for exposing the uniformly charged photoconductive surface layer to a pattern of light and shadow representing an original to be reproduced, whereby the surface layer is selectively discharged and a latent electrostatic image is produced thereon;

dielectric image drum means having an insulating surface and a conducting substrate onto which said latent electrostatic image is transferred by means of the ionization of air in a gap between said image drum and said photoconductive member;

means for toning said latent electrostatic image to form a visible counterpart;

a rotatable pressure drum in contact with said dielectric image drum, said rotatable pressure drum being coated with a stress absorbing plastics material; and a receptor web which passes between the dielectric image drum and said pressure drum at the point of contact.

16. The electrophotographic apparatus as defined in claim 15 wherein the stress absorbing material is of a class comprising nylon and polyester.

* * * * *